United States Patent [19]

Heuvinck

[11] Patent Number: 4,829,582

[45] Date of Patent: May 9, 1989

[54] ELECTRODYNAMIC TRANSDUCER

[75] Inventor: Leo A. K. Heuvinck, Dendermonde, Belgium

[73] Assignee: U.S. Philips Corp., New York, N.Y.

[21] Appl. No.: 8,671

[22] Filed: Jan. 29, 1987

[30] Foreign Application Priority Data

Feb. 4, 1986 [NL] Netherlands ..... 8600267

[51] Int. Cl.[4] ..... H04R 9/00; H04K 9/06

[52] U.S. Cl. ..... 381/194; 381/117; 381/124; 381/188

[58] Field of Search ..... 381/117, 124, 150, 188, 381/192, 194; 439/470, 449; 174/135

[56] References Cited

U.S. PATENT DOCUMENTS 4,097,106 6/1978 Over et al. ..... 174/135

FOREIGN PATENT DOCUMENTS 197708 8/1977 U.S.S.R. ..... 174/135
2119202 11/1983 United Kingdom .

OTHER PUBLICATIONS

"Der Lautsprecher in Detail", article from Funkschan 1983, part 7; pp. 99–103.
"Strain Relief Device", by G. E. Martin, IBM Tech. Discl. Bul., vol. 4, No. 5, Oct., 1961.
"Flying Lead Strain Relief", by C. R. Jackson, IBM Tech. Discl. Bul., vol. 23, No. 1, Jun., 1980.

*Primary Examiner*—John W. Caldwell, Sr.
*Assistant Examiner*—Tyrone Queen
*Attorney, Agent, or Firm*—Bernard Franzblau

[57] ABSTRACT

An electrical transducer comprising a magnet system (1), a diaphragm (5) and a voice-coil device (3, 4), coupled to the diaphragm. The voice coil (3) is situated in an air gap (2) of the magnet system and the magnet system is coupled to a chassis (7). The chassis is provided with a connection unit (10) having at least two coupling means (11, 14) each comprising a first terminal (12 and 15 respectively) for receiving an electric signal and a second terminal (13 and 16 respectively) electrically coupled to said first terminal. Each second terminal is electrically coupled to an electrical connection (20 and 21, respectively) of the voice coil via a lead (18 and 19 respectively). The leads (18, 19) are provided with a spacer (22) made of an electrically non-conductive material, for example, a plastic material (FIG. 2*a*). Preferably, the connection unit further comprises mechanical coupling elements (26, 27) which cooperate with the spacer to establish a mechanical coupling therebetween prior to the electrical coupling of the two leads (18, 19) to the two second terminals (13, 16). The mechanical coupling is established by clamping.

11 Claims, 2 Drawing Sheets

ELECTRODYNAMIC TRANSDUCER

This invention relates to an electrodynamic transducer comprising a magnet system, a diaphragm and a voice-coil device coupled to the diaphragm. The voice coil of the voice-coil device is situated at least partly in an air gap of the magnet system and the magnet system is coupled to a chassis, which chassis is provided with a connection unit comprising at least two electrical coupling means. Each electrical coupling means comprises a first terminal and a second terminal which are electrically coupled to one another, the first terminals of the two electrical coupling means being intended for receiving an electric signal and the second terminals of the two electrical coupling means each being electrically coupled to the two electrical connections of the voice coil via an associated lead. The invention further relates to a method for electrically coupling the two electrical connections of the voice coil to the two second terminals of the connection unit.

Figure 1:
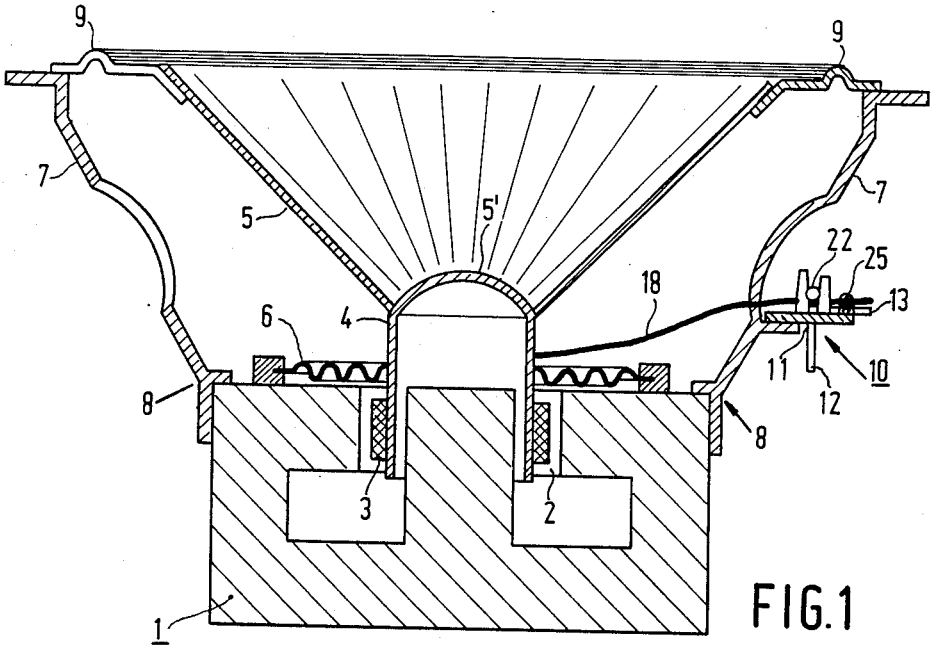

A transducer of the type defined in the opening paragraph is known from the article in Funkschau 1983, Part 7, "Der Lautsprecher im Detail", see pages 99–103, in particulare FIG. 1 on page 99.

In the known transducer this electrical coupling of the electrical connections of the voice coil to the two second terminals of the connection unit proceeds as follows:

—each of the connections of the voice coil is electrically coupled to one end of a corresponding lead, —near the other ends of the two leads spacer means in the form of a spiral spring are slid onto the leads. The spring, which is generally a metal spring, is retained as a result of the clamping force exerted on a lead by the two turns of the spiral between which a lead is fitted. The spring defines such a distance between the two leads that at the location where the leads are electrically coupled to the two second terminals this distance at least substantially corresponds to the distance between the two second terminals of the connection unit, —subsequently the voice-coil device (i.e. the voice coil with the leads and the spring and generally also the spider) is mounted on the chassis of the transducer in which the magnet system has already been mounted. This means that the voice coil is positioned in the air gap of the magnet system.

—subsequently, the leads are passed over the connection unit to enable the two leads to be electrically coupled to the two second terminals by soldering, —after this the spring is removed. The spring may be used again at a later stage, when leads are coupled to second terminals of another transducer.

From British Patent Application GB No. 2,119,202 A it is known to provide the connecting leads with spacer means to establish a mechanical coupling between the leads, which means are made of an electrically non-conductive material and are intended to keep the leads at such a distance from each other that, when these leads are electrically coupled to the second terminals, the distance between the leads at the location where they will be electrically coupled to the second terminals at least subtantially corresponds to the distance between the two second terminals of the connection unit.

In the transducer known from said British Patent Application the electrical coupling between the leads and the second terminals, however, is still rather laborious, so that the production time is relatively long and the production costs are comparatively high. Moreover, this transducer is found to produce an output signal with a relatively high distortion. It is an object of the invention to provide a transducer in which the electrical coupling is simplified so that the production costs can be reduced and which, moreover, produces an output signal with a lower degree of distortion. To this end the transducer in accordance with the invention is characterized in that the connection unit further comprises mechanical coupling means which cooperate with the spacer means to establish a mechanical coupling between the leads and the connection unit prior to the electrical coupling of the two leads to the two second terminals and in that the mechanical coupling between the mechanical coupling means and the spacer means is established by clamping.

By providing the leads with spacer means which are mechanically coupled to the leads and which by clamping cooperate mechanically with the mechanical coupling means of the connection unit, it is possible to form the mechanical connection between the spacer means and the mechanical coupling means of the connection unit before the electrical connection between the leads and the second terminals is made. Since the length of the leads between the mechanical connection to the voice-coil device and the spacer means is well-defined and is selected so as to allow for the required excess length of the leads between the voice coil and the second terminals, a correct electrical connection between the voice coil and the electrical coupling means can be made, the length of this connection being such that the movement of the voice coil during operation is not impeded.

This results in an electro-dynamic transducer with a reduced distortion and in a shorter production time.

The spacer means may take the form of a plastics wire. A suitable plastics is, for example, nylon.

The mechanical coupling between the plastics wire and the leads can be formed, for example, by pressing the leads into the plastics wire at a higher temperature at which the plastics slightly softens, so that subsequently the leads are at least partly fused into the plastics wire. The mechanical coupling means may comprise a space for taking-up the spacer means and may also comprise spaces for taking up a part of the length of the two leads.

The method of electrically coupling the voice coil to the two second terminals of the connection unit may be characterized in that (a) one end of the two leads is connected to an associated one of the two electrical connections of the voice coil, (b) the spacer means are mechanically coupled to the two leads, (c) the voice coil is positioned in the air gap of the magnet system which is mounted in a chassis, (d) the mechanical coupling between the spacer means and the mechanical coupling means of the connection unit is established by clamping, and subsequently (e) the electrical coupling between the two leads and the two second terminals is established.

The transducer may be characterized further in that the first terminals are constructed to enable a plugged connection to be made to electrical signal supply leads provided with plugs which are adapted to cooperate with the first terminals. Transducers provided with first terminals which are constructed in such a way that the coupling to the supply leads carrying the electric signal is established by means of a plugged connection are not known. Such a plugged connection enables the electrical coupling to the electrical supply leads to be made in a simple manner in transducers in accordance with the invention.

Figure 2A:
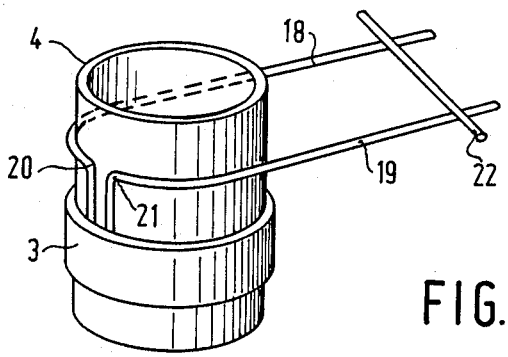
Figure 2B:
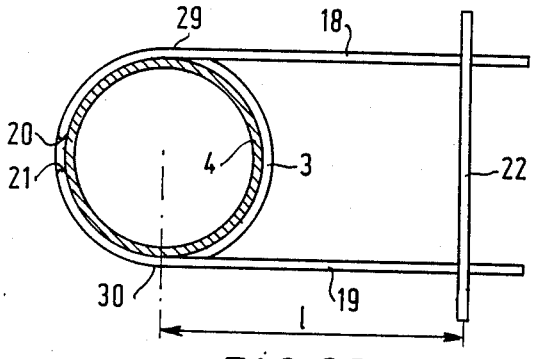
Figure 2C:
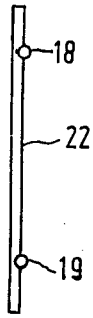
Figure 3A:
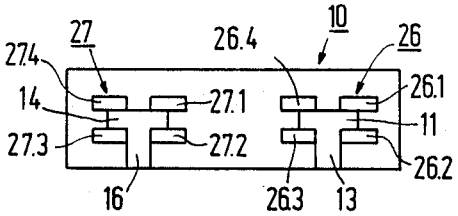
Figure 3B:
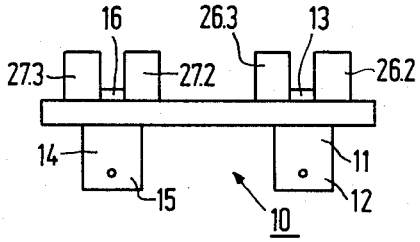
Figure 3C:
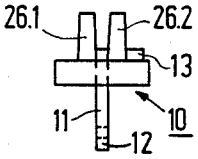
Figure 4A:
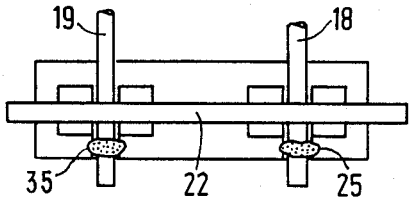
Figure 4B:
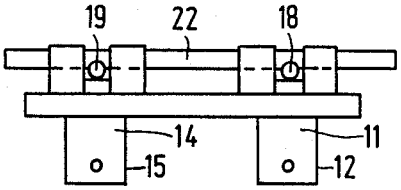
Figure 4C:
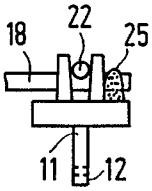

Embodiments of the invention will now be described in more detail, by way of example, with reference to the accompanying drawings in which elements bearing the same reference numerals in different Figures are identical. In the drawings:

FIG. 1 shows the electro-dynamic transducer in accordance with the invention, FIGS. 2*a* and 2*c* are views of the voice-coil in a plan view of a section of the voice-coil device of the transducer shown in FIG. 1 and FIG. 2*b* is a plan view of a section of the voice-coil device taken just above the connecting wires, FIGS. 3*a*, 3*b* and 3*c* are three views of the connection unit, and FIGS. 4*a*, 4*b* and 4*c* are three similar views of the connection unit showing the cooperation of the mechanical coupling means with the spacer means.

FIG. 1 is a sectional view of an electrodynamic transducer in the form of a loudspeaker. The transducer comprises a magnet system 1, known per se. As the magnet system is of a conventional type, it is shown only schematically and it will not be described in detail. The magnet system forms an air gap 2 in which a voice coil 3 is arranged, mounted on a voice-coil former 4. One end of the voice-coil former 4 is secured to a diaphragm 5 of a conical shape. At this end the voice-coil former 4 is closed by a dust cap 5'. Moreover, by means of a centering element or spider 6 the voice-coil former 4 is coupled to a chassis 7 via the magnet system 1. The magnet system 1 is mounted in chassis 7 by the fixing means at 8. The outer circumference of the diaphragm 5 is secured to the chassis 7 via a flexible rim 9. The chassis 7 carries a connection unit 10 comprising two electrical coupling means. One of these coupling means bears the reference numeral 11 in FIG. 1. The coupling means 11 comprises a first terminal 15 and a second terminal 16 which are electrically interconnected. The coupling means 11 is L-shaped, as is apparent from FIG. 3*c*. The L-shaped second coupling means bears the reference numeral 14 in FIG. 3, which shows some side views of the terminal block 10, and also comprises a first terminal 15 and a second terminal 16 which are electrically interconnected. An electric signal can be applied to the first terminals 12 and 15. The second terminals 13 and 16 are electrically coupled to the respective electrical connections 20 and 21 of the voice coil 3 via associated leads 18 and 19 respectively. FIG. 1 only shows the lead 18. FIG. 2 shows the voice-coil device with both leads 18 and 19.

The first terminals 12, 15 comprise a lug, see FIG. 3*b*, so that the electrical signal-supply leads (not shown) to be connected can be soldered to the terminals 12, 15. It is alternatively possible to construct the first terminals 12, 15 differently, for example, in such a way that a plugged connection can be established between the terminals 12, 15 and the signal supply leads provided with suitable plugs.

The voice-coil device is provided with spacer means 22 which are mechanically coupled to the leads 18 and 19. The spacer means 22 take the form of a plastic wire, for example a nylon wire. The mechanical coupling between the plastic wire 22 can be formed by pressing the leads 18 and 19 into the plastic wire 22 at a higher temperature at which the plastic wire softens. After cooling the leads 18 and 19 are partly fused into the plastic wire 22, as is clearly visible in FIG. 2c.

The spacer means 22 serve to define the distance between the leads 18 and 19 at the location where these leads are electrically coupled to the second terminals 13 and 16 respectively (by means of soldered joints 25 and 35 respectively).

The spacer means 22 further cooperate with mechanical coupling means 26 and 27 of the connection unit 10, see FIG. 3.

In FIG. 3, FIG. 3a is a plan view and FIGS. 3*b* and 3*c* are two side views of the connection unit 10, and FIG. 4 gives similar views of the connection unit 10 showing the spacer means 22 when mechanically coupled to the mechanical coupling means 26 and 27.

The coupling means 26 comprise four projections 26.1 to 26.4. In the present example the four projections are arranged (more or less) symmetrically relative to one another, each in a quadrant of a system of axes which coincide with the longitudinal directions of the spacer means 22 and the lead 18, the origin of the system being situated at the location where the spacer means 22 and the lead 18 are coupled to one another. At this location the longitudinal directions extend perpendicularly to one another, as is apparent from FIG. 4a. The distance between the facing sides of the projections 26.1 to 26.2 and of the projections 26.3 and 26.4 decreases in a downward direction. The spacer means may now be pressed into the space between the projections 26.1 and 26.2 and the space between the projections 26.3 and 26.4 until they are clamped in position between these projections.

The projections 26.1 and 26.4 and the projections 26.2 and 26.3 bound a space which is large (wide) enough to accommodate a part of the length of the lead 18. This also applies to the projection 27.1 to 27.4, which constitutes the mechanical coupling means 27.

The mechanical coupling means 26 and 27 may also be constructed in a different way. For example, it is possible to interconnect the projections 26.4 and 27.1 as well as the projections 26.3 and 27.2. In that case the projections 26.1, 26.2, 27.3 and 27.4 may even be dispensed with. The width of the interconnected projections 26.4, 27.1 and 26.3, 27.2 need not be equal to the distance between the leads 18 and 19 if the ends of the leads 18 and 19 can be positioned on the second terminals 13 and 16 respectively in a different way.

The method of electrically coupling the two electrical connections 20 and 21 to the two terminals 13 and 16 respectively of the connection unit will be explained hereinafter.

(a) The voice coil 3 is wound on the voice-coil former 4 and subsequently first ends of two leads 18 and 19 are electrically coupled to the connections 20 and 21, respectively, by soldering.

(b) Subsequently, the spacer means 22 are mechanically coupled to the two leads 18 and 19. This results in the construction shown in FIG. 2a. The spacer means 22 are coupled to the two leads 18 and 19 at such a location that the length 1, which is the length of the leads 18 and 19 between the points 29 and 30 respectively where they are mechanically coupled to the voice-coil former and the spacer means 22, is such that some slack is obtained to ensure that the movement of the voice-coil device during operation of the transducer is not impeded.

(c) Subsequently, the voice-coil device, i.e. the construction shown in FIG. 2a, in which a spider 6 has been coupled to the voice-coil former 4 prior to step (b), is arranged in the air gap 2 of the magnet system. Usually, this magnet system is already mounted in the chassis 7. The voice-coil 3 is centered in the air gap 2 by means of the spider 6, which is secured to the magnet system for this purpose.

(d) Subsequently, the mechanical coupling between the spacer means 22 and the mechanical coupling means 26, 27 is made, for example by clamping, (e) After this the two leads 18, 19 are electrically coupled to the two second terminals 13, 16 by means of soldered joints 25 and 35, see FIGS. 4a and 4c.

As stated hereinbefore, it is necessary to provide a certain slack for the leads 18, 19 in order not to impede the movement of the voice coil and hence of the cone 5. Sometimes it may happen that during use of the transducer the leads hit the cone 5 as a result of their movement, which may give rise to undesired noises. In order to preclude this, the leads 18, 19 are attached to the spider 6, for example somewhere halfway of the connection between the voice coil 3 and the connection unit 10. This (mechanical) connection can be made by means of, for example, a staple (not shown).

It is to be noted that different modifications in the embodiments described with reference to the drawing are possible within the scope of the invention, as defined in the appended Claims. For example, the transducer may have a diaphragm of a different shape, for example a flat or dome-shaped diaphragm. Further, it is not necessary that the connection unit 10 be integral with the two electrical coupling means. For example, it is also possible that the connection unit comprises two separate coupling means which ar each mechanically coupled to the chassis 7.

What is claimed is:

1. An electrodynamic transducer comprising a magnet system, a diaphragm and a voice-coil device couled to the diaphragm, a voice coil of the voice-coil device being situated at least partly in an air gap of the magnet system, the magnet system being coupled to a chassis is provided with a connection unit comprising at least two electrical coupling means, each electrical coupling means comprising a first terminal and a second terminal electrically coupled to one another, the first terminals of the two electrical coupling means being intended for receiving an electric signal and the second terminals of the two electrical coupling means each being electrically coupled to two electrical connections of the voice coil via an associated lead, spacer means providing a mechanical coupling between the leads, which spacer means is made of an electrically non-conductive material and keeps the leads spaced from each other by a distance such that when said leads are electrically coupled to the two second terminals the distance between the leads at the location where they are to be electrically coupled to the second terminals at least substantially corresponds to the distance between the two second terminals of the connection unit, characterized in that the connection unit further comprises mechanical coupling means which cooperates with the spacer means to establish a mechanical coupling between the leads and the connection unit prior to the electrical coupling of the two leads to the two second terminals and in that the mechanical coupling between the mechanical coupling means and the spacer means is established by clamping.

2. A transducer as claimed in claim 1, characterized in that the spacer means comprise a plastic wire.

3. A transducer as claimed in claim 2, characterized in that the mechanical coupling between the plastic wire and the leads is formed by pressing the leads into the plastic wire at a higher temperature.

4. A transducer as claimed in claim 2, characterized in that the plastic comprises a nylon material.

5. A transducer as claimed in claim 1, characterized in that at the location where the spacer means is mechanically coupled to the leads the longitudinal direction of said spacer means extends at least substantially perpendicular to the longitudinal direction of the leads.

6. A transducer as claimed in claim 5, characterized in that the mechanical coupling means is formed with a space for taking up the spacer means.

7. A transducer as claimed in claim 5, characterized in that the mechanical coupling means is formed with spaces for taking up a part of the length of the two leads.

8. A method of electrically coupling two electrical connections of a voice coil to two second terminals of a connection unit in a transducer comprising:

(a) connecting one end of each of two leads to an associated one of the two electrical connections of the voice coil, (b) mechanically coupling a spacer means to the two leads, (c) positioning the voice coil in an air gap of a magnet system of the transducer, (d) providing a mechanical coupling between the spacer means and a mechanical coupling means of the connection unit by clamping, and subsequently (e) establishing the electrical coupling between the two leads and the two second terminals.

9. A transducer as claimed in claim 1, characterized in that the first terminals are constructed to enable a plugged connection to be made to electrical signal-supply leads provided with plugs which are adapted to cooperate with the first terminals.

10. A transducer as claimed in claim 1 wherein the mechanical coupling means includes a space for receiving the spacer means.

11. A transducer as claimed in claim 1 wherein the mechanical coupling means includes spaces for taking up a part of the length of the two leads.

* * * * *